US006099603A

United States Patent [19]

Johnson

[11] Patent Number: 6,099,603

[45] Date of Patent: Aug. 8, 2000

[54] SYSTEM AND METHOD OF ATTACHING ABRASIVE ARTICLES TO BACKING PADS

[75] Inventor: Scott Johnson, Peterborough, N.H.

[73] Assignee: Johnson Abrasive Company, Inc., Jaffrey, N.H.

[21] Appl. No.: 09/222,356

[22] Filed: Dec. 29, 1998

[51] Int. Cl.[7] ..... B24D 11/00; B24D 11/02; B24D 17/00

[52] U.S. Cl. ..... 51/297; 51/295; 51/293; 451/538; 451/541; 451/540; 451/548; 428/95; 428/99; 428/100

[58] Field of Search ..... 51/293, 295, 297; 451/538, 540, 541, 548; 428/95, 99, 100

[56] References Cited

U.S. PATENT DOCUMENTS

| | | | |
|---|---|---|---|
| 4,558,542 | 12/1985 | Marton | 51/358 |
| 4,609,581 | 9/1986 | Ott | 428/100 |
| 4,617,767 | 10/1986 | Ali | 51/358 |
| 4,951,423 | 8/1990 | Johnson | 51/168 |
| 5,007,128 | 4/1991 | Englund et al. | 15/230.17 |
| 5,054,245 | 10/1991 | Coty | 51/170 |
| 5,123,139 | 6/1992 | Leppert et al. | 15/230.17 |
| 5,201,785 | 4/1993 | Nagano | 51/358 |
| 5,254,194 | 10/1993 | Ott et al. | 156/176 |
| 5,354,591 | 10/1994 | Ott et al. | 428/99 |
| 5,505,747 | 4/1996 | Chesley et al. | 51/297 |
| 5,667,540 | 9/1997 | Chesley et al. | 51/293 |
| 5,672,186 | 9/1997 | Chesley et al. | 51/297 |
| 5,785,784 | 7/1998 | Chesley et al. | 156/66 |

*Primary Examiner*—Michael Marcheschi
*Attorney, Agent, or Firm*—Bourque & Associates, P.A.

[57] ABSTRACT

A system and method for attaching an abrasive article to a backing pad is provided. The system includes a backing pad including loop-textile material applied to an attachment surface thereof and an abrasive article, which is removably attached thereto. The abrasive article has at least first and second surfaces including a plurality of abrasive particles adhered thereto. The first surface of the abrasive article includes abrasive particles having a size and density selected to provide a desired surface finish of a workpiece surface being abraded with the abrasive article. The second surface includes a plurality of abrasive particles having a size and density selected to releasably engage textile loops extending from the loop textile material applied to the backing pad attachment surface. Various embodiments, including double-sided sandpaper sheets and sanding screens, which adhere to the textile loops extending from the loop textile material applied to the backing pad attachment surface are disclosed.

19 Claims, 3 Drawing Sheets

SYSTEM AND METHOD OF ATTACHING ABRASIVE ARTICLES TO BACKING PADS

FIELD OF THE INVENTION

The invention relates to a system and method of attaching abrasive articles to backing pads and more particularly, a system for attaching abrasive disks or abrasive sheets to manual and powered sanders.

BACKGROUND OF THE INVENTION

Abrasive articles are used in a variety of fields for abrading material from a surface of a workpiece. For example, an abrasive disk may be releasably mounted on a back-up pad for rotative movement by a random orbital sander. When the disk is rotated, and the exposed abrasive surface of the disk is urged against the workpiece surface, material may be removed from the workpiece.

Abrasive disks are typically releasably attached to a back-up pad, which supports the abrasive disk during the abrading process. Several types of abrasive disks have some type of attachment system incorporated into the disk to enable the disk to be releasably attached to a back-up pad. For example, abrasive disks having a layer of pressure sensitive adhesive (PSA) on the back surface (the surface opposite the abrasive surface) are typically made by applying a layer of pressure sensitive adhesive on the back surface of the disk.

Another type of abrasive disk includes a textile material on the back surface of the disk. Textile disks are typically used in conjunction with a back-up pad having a plurality of engaging members that are bonded to the attachment surface of the back-up pad. The engaging members on the back-up pad are designed to engage the textile material of the textile disk, to secure the abrasive disk to the back-up pad.

A third type of abrasive disk, known as "stalk disks", include a plurality of engaging members in the forms of inclined stalks. The stalks have unhooked ends, which slidingly intermesh with a textile material on a back-up pad to secure the abrasive disk to the back-up pad. The method used to make stalk disks generally involves a knitting process (such as warp knitting), that produces a woven base layer formed from multi-filament yarn. Spaced stalks are woven into the knitted base layer, and are inclined with respect to, and project away from, the base layer. The woven stalk material may then be laminated to an abrasive sheet to produce an abrasive article.

A fourth type of abrasive disk involves providing an abrasive sheet having a first major surface including a means for abrading the surface of a workpiece and a second surface, which includes a plurality of projecting stems that enable the stem to releasably hook an opposed engaging structure, such as a loop-type textile material included on a backing pad.

While all of the above-mentioned systems used for attaching abrasive articles to backing pads provide acceptable attachment systems, they each suffer from one or more significant disadvantage. For example, the thickness of a PSA layer is often critical to the performance of a PSA abrasive disk. Accordingly, sophisticated, expensive machines are required to control the coating of PSA's to abrasive articles. Additionally, suitable textiles for hook and loop-type fastening systems are generally expensive, especially when compared to pressure sensitive adhesives. Thus, adding textile materials to the back side of disposable abrasive articles increases their cost. Furthermore, adding textile materials to the back side of abrasive articles requires unique, sophisticated equipment. Likewise, the raw materials used to make stalk disks are expensive and require sophisticated manufacturing and material handling systems.

Similarly, although expensive textile backing pads can be reused, when used with attachment hooks provided on the back side of abrasive articles, these systems still require the inclusion of a hooking material on the back side of abrasive articles. As can be appreciated, this adds an additional cost element to abrasive articles using such an attachment system.

Accordingly, there exists a need for an abrasive article attachment system and method, which eliminates the need for providing a separate attachment mechanism to an abrasive article and thus eliminates the cost associated with additional manufacturing steps.

SUMMARY OF THE INVENTION

The present invention includes a system and method for attaching an abrasive article to a backing pad. The system includes a backing pad including loop-textile material applied to an attachment surface thereof and an abrasive article, which is removably attached thereto. The abrasive article has at least first and second surfaces including a plurality of abrasive particles adhered thereto. The first surface of the abrasive article includes abrasive particles having a size and density selected to provide a desired surface finish of a workpiece surface being abraded with the abrasive article. The second surface includes a plurality of abrasive particles having a size and density selected to releasably engage textile loops extending from the loop textile material applied to the backing pad attachment surface.

In one embodiment, the abrasive article includes a double-sided sandpaper sheet, having first and second surfaces which may have similarly or different sized abrasive particles adhered to the first and second surfaces. In another embodiment of the invention, the abrasive article comprises a sanding screen of the type commonly used in the drywall industry. In this embodiment, the backing pad includes a loop textile material having textile loops extending from an attachment surface thereof, much like that summarized above. However, in this embodiment, the abrasive article comprises a mesh abrasive carrier having front, back and side surfaces. At least one layer of abrasive particles is adhered to the mesh abrasive carrier. The abrasive particles adhered to at least one layer are adapted to be releasably engaged to the loops extending from the loop textile material attachment surface included on the backing pad. This embodiment may also include abrasive particles having different sizes and densities adhered to the different surfaces of the mesh abrasive carrier.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
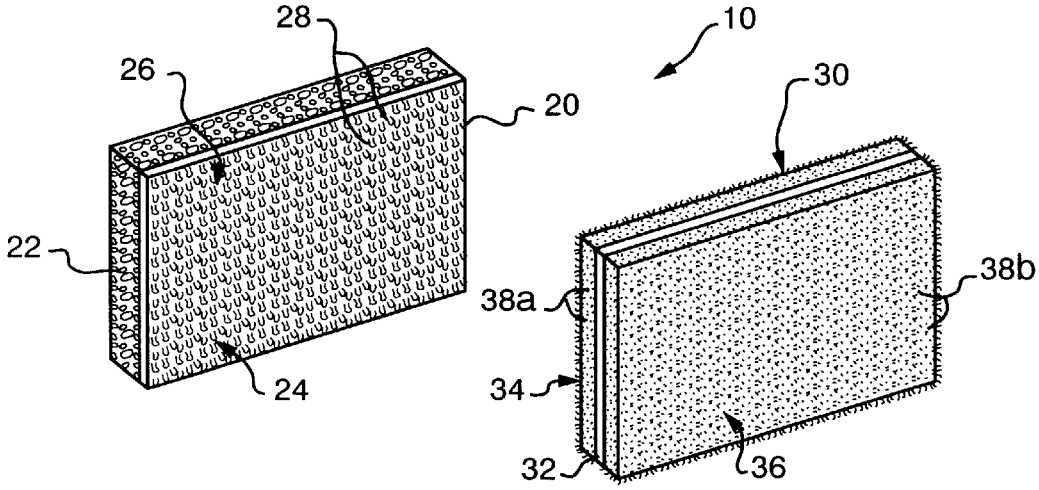
FIG. 1 is a perspective view of a system for attaching an abrasive article to a backing pad according to the present invention, showing a backing pad including a loop textile attachment surface and an abrasive article having abrasive particles adhered to first and second surfaces thereof.
Figure 2:
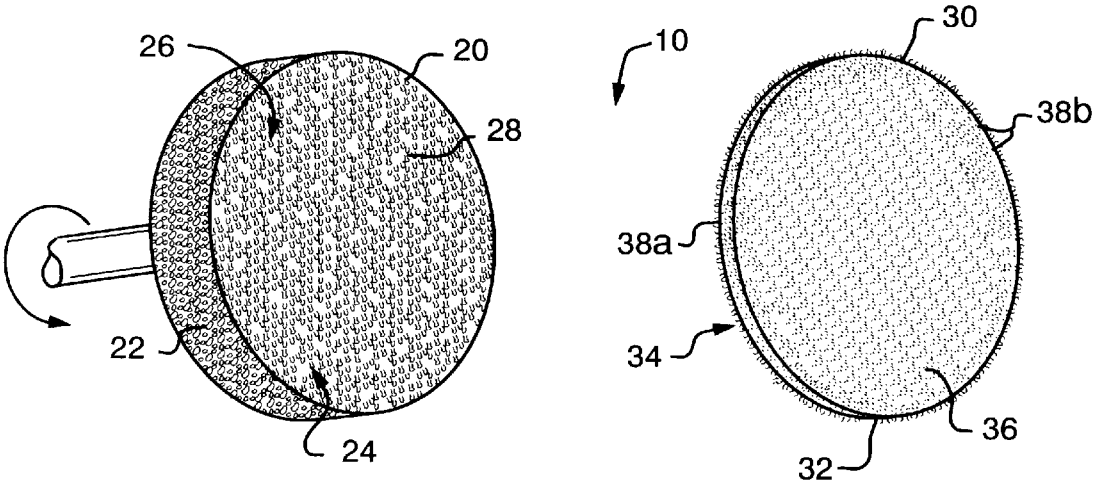
FIG. 2 is an alternative embodiment of the system for attaching an abrasive article to a backing pad of FIG. 1, wherein the backing pad is attached to a rotational shaft for rotary disk sanding applications.

Turning now to the figures and, in particular, FIGS. 1 and 2, a system 10 for attaching an abrasive article to a backing pad according to the present invention is shown. The system includes a backing pad 20 and an abrasive article 30.

The backing pad 20 includes a loop textile material 24 applied to an attachment surface 26 of the backing pad 20. In the preferred embodiment, the backing pad 20 includes a semi-resilient backing layer 22, which aids in providing a smooth finished surface when the abrasive article 30 is releasably engaged with the loop textile attachment surface of the backing pad 20. This is accomplished by selecting a semi-resilient backing pad material 22, which deforms a desired amount under pressure as a workpiece is being abraded with the abrasive article.

Various means may be employed for attaching the loop textile material 24 to the semi-resilient backing pad 22, all of which are known to those skilled in the art, including, mechanical fastening systems, such as stitching, as well as chemical attachment systems, such as binding adhesives. In addition, double-sided loop textile backing pads may be used in conjunction with prior art attachment systems which include a backing pad having hooks extending therefrom. This embodiment would be useful for retrofitting existing tools that incorporate hook and loop abrasive sheet attachment systems.

In any case, the attachment system used to attach the loop textile material 24 to the backing pad 22 must be selected to provide superior adherence of the loop textile material to the backing pad. In this regard, it would be more difficult to remove the loop textile material 24 from the backing pad 22 than it would be to remove the abrasive article 30 from the loop textile material 24 so that removal and replacement of abrasive articles would not necessarily involve removal of the loop textile material from the backing pad.

Using the removable/replacable loop textile material embodiment, loop textile materials having different loop sizes and densities may be selectively attached to the backing pad. As will become more apparent below, since it is the engagement of the abrasive particles included on the abrasive article that releasably engages the textile loops extending from the loop textile material, loops of different sizes and densities may be more appropriate and thus provide better adherence for abrasive articles having different abrasive characteristics (e.g. different grit sandpapers).

The abrasive article 30 includes an abrasive backing 32 having at least first and second surfaces 34 and 36, respectively. The first and second surfaces 34 and 36 include a plurality of abrasive particles 38 deposited thereupon. The abrasive particles 38*a* on the first side 34 of abrasive article 30 are chosen to have a size, shape and deposition density suitable for releasably engaging textile loops 28, which extend from the loop textile attachment surface 26 of the backing pad 20.

The abrasive particles 38*b* deposited on the second surface of abrasive article 30 have a size, shape and deposition density, which are selected to provide a desired surface finish of a workpiece surface being abraded with the abrasive article 30.

In one embodiment of the invention, the abrasive article 30 comprises a double-sided sandpaper sheet, with abrasive particles 38 of substantially the same size and density deposited on the first and second surfaces thereof. When the abrasive article according to this embodiment is used so that the surface abrading the workpiece is used up, the double-sided sandpaper can be removed from the backing pad 20, inverted and re-attached to the backing pad so that the opposite surface of the double-sided abrasive sandpaper is now exposed for use in abrading a workpiece being finished.

Figure 3:
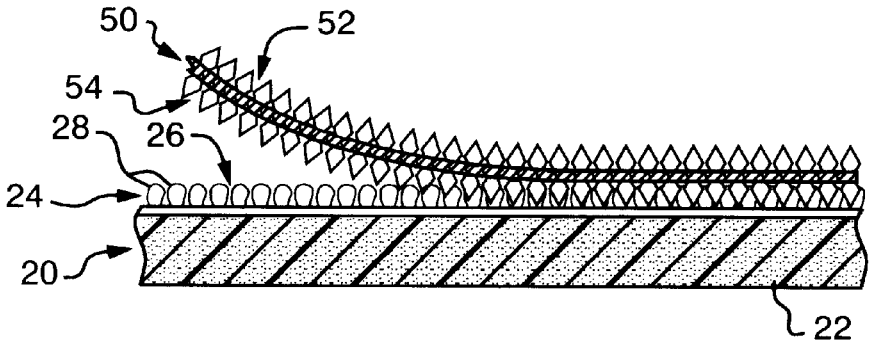
FIG. 3 is a side view of a system for attaching an abrasive article to a backing pad according to the present invention.

In FIG. 3, a double-sided sandpaper sheet 50 having similarly sized abrasive particles on first and second surfaces thereof 52 and 54 is shown. As can be seen in the figure, the abrasive particles comprise non-uniform, jagged shapes, which, when pressed into the attachment surface 26 of backing pad 20 releasably engage with the loops 28 extending from the loop textile material 24. In other words, the jagged shape of the abrasive particles themselves serves the purpose served by hook members of prior art attachment systems using both hook and loop layers. To remove the double-sided sandpaper sheet 50, it is preferably peeled from one side, which disengages the jagged abrasive particles from the loops.

Figure 4:
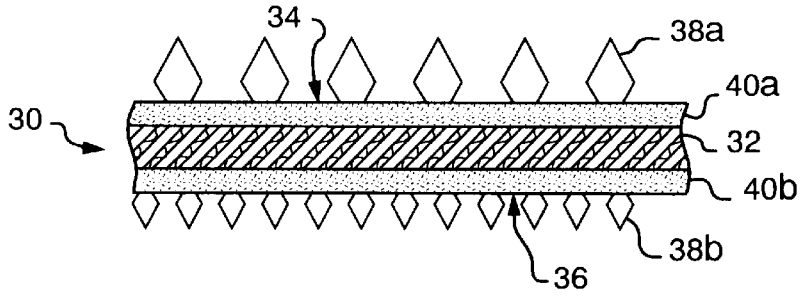
FIG. 4 is a close-up sectional view of one embodiment of an abrasive article according to the present invention showing different size abrasive particles adhered to first and second surfaces thereof.

FIG. 4 shows a double-sided abrasive sheet having an abrasive carrier 32 having abrasive particles of a first size and density 38*a* adhered to a first surface 34 using an adhesive layer 40*a*, which is well known in the art. The second surface 36 has abrasive particles of a second size 38*b*, in this case smaller, more closely spaced abrasive particles, adhered thereto using a second adhesive layer 40*b*.

Figure 5:
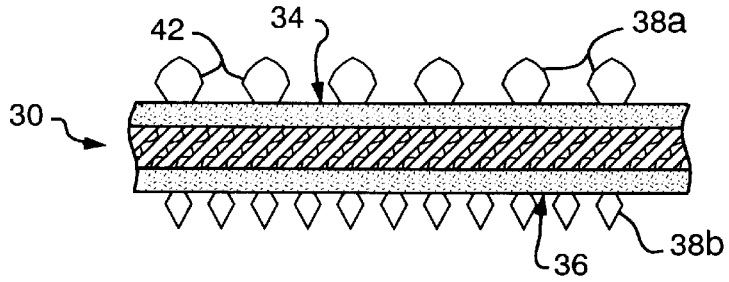
FIG. 5 is a close-up sectional view of an abrasive article according to the present invention showing abrasive particles adhered to a first side thereof being worn down following use.

As can be seen in FIG. 5, the abrasive particles 38*a* on the first side 34 of the abrasive article 30 have been worn down due to use. However, even the worn down particles have substantially jagged shoulders 42, which are sufficient to releasably engage the loops extending from the loop textile material attachment surface of a backing layer. Thus, in this embodiment of the invention, a double-sided sandpaper sheet can be reversed after a first side is used to abrade a workpiece and the unused abrasive particles adhered to the second surface thereof can be exposed for continued abrading of the workpiece.

In the example of FIG. 5, the first surface 34 of the abrasive particles 38*a* uses coarse grain abrasive articles, whereas the second surface 36 of the abrasive article 30 includes fine grain abrasive particles 38*b*. Thus, multi use, double-sided sandpaper sheets can be produced.

Figure 7:
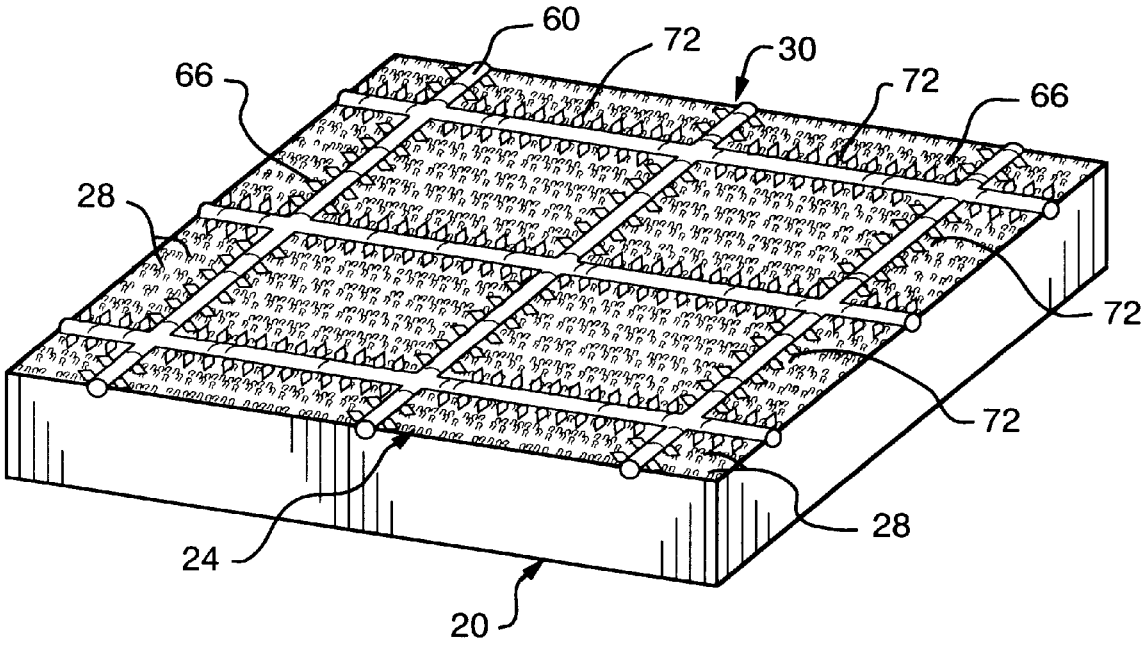
FIG. 7 is a close-up perspective view of an abrasive article according to FIG. 6 attached to a loop textile backing pad, showing the engagement of the abrasive particles adhered to the mesh abrasive carrier with loops extending from the loop textile material.
Figure 6:
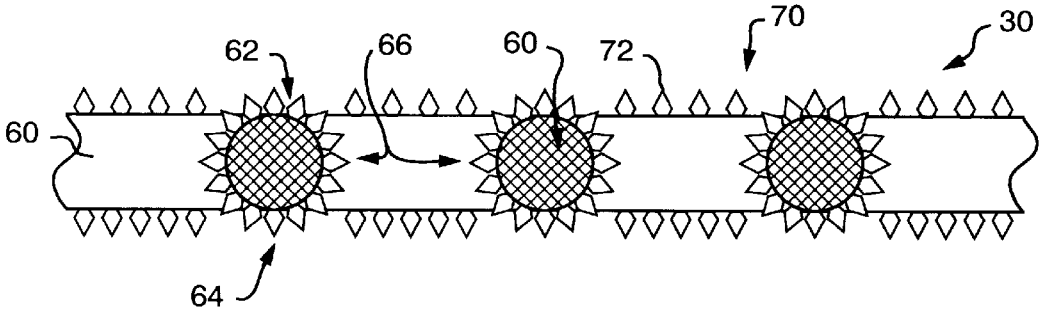
FIG. 6 is a close-up sectional view of an alternative embodiment of an abrasive article according to the present invention comprising a mesh abrasive carrier having abrasive particles adhered to front, back and side surfaces thereof.

An alternative embodiment of the present invention is shown in FIGS. 6 and 7. In this embodiment, the abrasive article 30 is provided as a sanding screen. The sanding screen includes a mesh-like abrasive carrier 60. The mesh-like abrasive carrier 60 provides a front surface 62, a back surface 64 and side surfaces 66. At least one layer of abrasive particles 70 is adhered to the mesh abrasive carrier. However, multiple layers or layers including different sized and shaped abrasive particles can be applied, independently, to the front, back and side surfaces of the abrasive carrier. The abrasive particles 72 are adapted to releasably engage loops extending from the loop textile material attachment surface included on the backing pad 20 in a manner similar to that described above with respect to the double-sided sandpaper embodiment. However, the additional abrasive particles applied to the side surfaces of the mesh-like carrier provide even better adherence to the textile loops extending from the loop-textile material backing pad.

This embodiment is especially suitable for use in drywall applications and may be implemented as rectangular shaped sanding screens for hand sanding applications and circular sanding screen disks, which may be applied to rotary sanding tools.

Figure 8:
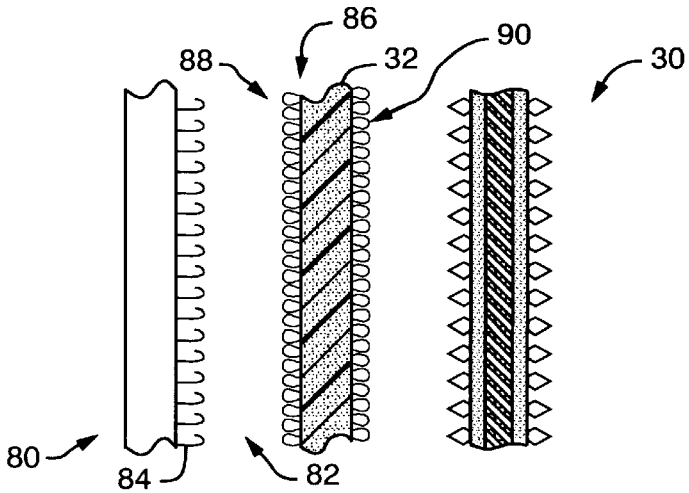
FIG. 8 is a sectional view of another embodiment of the present invention, wherein a double-sided loop textile backing pad is utilized to retrofit an existing abrasive tool, which incorporates prior art hook type fasteners.

FIG. 8 shows another embodiment of the invention, wherein a prior art abrasive tool 80, which includes an attachment surface 82, including prior art hook type fastener elements 84, may be retrofitted to incorporate a loop textile backing pad configured to hold abrasive articles according to the principles of the present invention. This embodiment includes a double-sided loop textile backing pad 86. The backing pad 86 has a first attachment surface 88 on a first side thereof and a second attachment surface 90 on a second side thereof. The backing pad may simply include a double-sided loop textile material sheet or, in a more robust embodiment, it may incorporate a resilient layer 92 intermediate the first and second attachment surfaces.

The first attachment surface 88 is configured to attach to the hook-type fasteners 84 provided on the attachment surface 82 of the abrasive tool 80. An abrasive article 30, which may take any one of the forms described above, is attached to the second attachment surface 90 provided by the double-sided loop textile backing pad 86. Thus, a double-sided loop textile backing pad may be utilized to allow for the adaptation of existing abrasive or sanding tools to be utilized with the abrasive article attachment system of the present invention.

Acceptable loop textile materials may comprise knitted loop, woven loop or non-woven loop textile materials. However, in any case with respect to the different embodiments of the invention, it is important to utilize a loop textile material, which includes loops of an appropriate size and loop density to provide adequate attachment of the abrasive article 30 to the backing pad 20. This is especially critical in applications that involve high-speed rotary disk sanders, where the abrasive articles may travel at hundreds or thousands of revolutions per minute. Experimental testing has shown that knitted loop textile materials and, in particular, the knitted loop textile materials sold under the designations "3800" and "3905" by Velcro USA, Inc. provide excellent adherence to abrasive articles having abrasive particles of the size, shape and density found in standard ranges of common sandpaper sheets and sanding screens. Of course, specialty applications may utilize more narrowly defined loop textile materials.

Thus, the disclosed invention provides a useful system and method of attaching an abrasive article to a backing pad. The method includes applying a loop textile material to an attachment surface of a backing pad. The loop textile material includes a plurality of textile loops extending from the attachment surface. Next, at least a first layer of abrasive particles is adhered to a first surface of an abrasive particle carrier. The first layer of abrasive particles include particles selected to provide releasable engagement of the abrasive article with the backing pad.

At least a second layer of abrasive particles is then adhered to a second surface of the abrasive particle carrier. The second layer of abrasive particles is selected to provide a desired surface finish on a workpiece being abraded using the abrasive article.

The abrasive article is then releasably engaged to the backing pad by engaging the abrasive particles adhered to one of either the first or second surfaces of the abrasive particle carrier with the plurality of textile loops extending from the backing pad attachment surface. Upon completion of an abrading process, the abrasive article is simply peeled from the backing pad, thereby releasing the engagement between the abrasive particles and the plurality of textile loops.

Accordingly, a new and useful system and method for attaching abrasive articles to backing pads is provided, which eliminates the need for attaching separate, distinct hook-type objects to a back side of an abrasive article. Thus, the disclosed invention facilitates the implementation of double-sided sandpaper and sanding screens which can be easily and readily attached and removed from a backing pad.

Modifications and substitutions by one of ordinary skill in the art are considered to be within the scope of the present invention, which is not to be limited except by the claims which follow.

What is claimed is:

1. A system for attaching an abrasive article to a backing pad comprising:

a backing pad including a loop-textile material applied to an attachment surface thereof and an abrasive article including an abrasive carrier having at least first and second surfaces wherein at least said first surface includes a plurality of abrasive particles deposited thereon, said abrasive particles having a size, shape and deposition density selected to releasably engage textile loops extending from said loop-textile material applied to said backing pad attachment surface and wherein at least said second surface includes a plurality of abrasive particles deposited thereon, said abrasive particles having a size, shape and deposition density selected to provide a surface finish of a workpiece surface being abraded with said abrasive article.

2. A system for attaching an abrasive article to a backing pad comprising:

a backing pad including a loop-textile material applied to an attachment surface thereof and an abrasive article including an abrasive carrier having at least first and second surfaces, said first and second surfaces including a plurality of abrasive particles deposited thereon, said abrasive particles having a size, shape and deposition density selected for releasably engaging a plurality of textile loops extending from said loop-textile material applied to said backing pad attachment surface.

3. The system for attaching an abrasive article to a backing pad as claimed in claim 2, wherein said backing pad is attached to a rotary disk sander.

4. The system for attaching an abrasive article to a backing pad as claimed in claim 2, wherein said backing pad is attached to a random orbital sander.

5. The system for attaching an abrasive article to a backing pad as claimed in claim 2, wherein said backing pad is attached to a manually powered sanding block.

6. The system for attaching an abrasive article to a backing pad as claimed in claim 2, wherein said abrasive particle deposition densities of said abrasive particles on said at least first and second surfaces is substantially the same.

7. The system for attaching an abrasive article to a backing pad as claimed in claim 2, wherein said abrasive article comprises a double-sided sandpaper sheet.

8. The system for attaching an abrasive article to a backing pad as claimed in claim 1, wherein said abrasive article comprises a double-sided sandpaper disk.

9. The system for attaching an abrasive article to a backing pad as claimed in claim 2, wherein said abrasive article comprises a sanding screen.

10. The system for attaching an abrasive article to a backing pad as claimed in claim 2, wherein said backing pad further comprises a plurality of hook-type fasteners extending therefrom and wherein said attachment system includes a double sided loop textile material having a first attachment surface on a first side thereof for releasably engaging said hook-type fasteners extending from said backing pad and wherein said double sided loop textile material includes a second attachment surface on a second side thereof for releasably engaging said abrasive particles deposited on at least one of said first and second surfaces of said abrasive article.

11. A system for attaching abrasive articles to a backing pad comprising:

at least one loop textile attachment layer attached to said backing pad, said loop textile attachment layer having an attachment surface and at least one sheet of coated abrasive material comprising an abrasive carrier having at least front and rear surfaces, a layer of abrasive articles adhered to said front surface, and a layer of abrasive particles adhered to said rear surface, wherein said at least one sheet of coated abrasive material is adapted to be releasably retained on said at least one loop textile attachment layer attached to said backing pad by releasable engagement of at least one of said layers of abrasive particles adhered to said front and back surfaces of said sheet of coated abrasive material.

12. The system for attaching an abrasive article to a backing pad as claimed in claim 11, wherein said at least one loop textile attachment layer comprises a plurality of loop textile attachment layers, attached to said backing pad, each of said loop textile attachment layers having a loop size and loop density selected to facilitate said releasable engagement of a sheet of coated abrasive material having an abrasive particle layer which includes abrasive particles of a size and particle density.

13. The system for attaching an abrasive article to a backing pad as claimed in claim 11, wherein said abrasive material backing comprises a mesh having front, rear and side surfaces, and wherein said front, rear and side surfaces have abrasive particles adhered thereto, said abrasive particles adhered to at least said side surface being adapted to releasably engage said at least one loop textile attachment layer of said backing pad.

14. A system for attaching an abrasive article to a backing pad comprising:

a backing pad including a loop-textile material on an attachment surface and an abrasive article comprising a mesh abrasive carrier having front, back and side surfaces and at least one layer of abrasive particles adhered to said mesh abrasive carrier, wherein said abrasive particles comprising said at least one layer are adapted to releasably engage said loops extending from said loop textile material attachment surface included on said backing pad.

15. The system for attaching an abrasive article to a backing pad as claimed in claim 14, wherein said at least one layer of abrasive particles adhered to said surfaces of said mesh abrasive carrier comprises a first layer of abrasive particles adhered to said front surfaces of said mesh abrasive carrier, a second layer of abrasive particles adhered to said back surfaces of said mesh abrasive carrier and a third layer of abrasive particles adhered to said side surfaces of said mesh abrasive carrier.

16. The system for attaching an abrasive article to a backing pad as claimed in claim 15, wherein at least one of said first, second and third layers of abrasive particles comprises abrasive particles having a particle size and density differing from an abrasive particle size and density of at least a second of said first, second and third layers of abrasive particles.

17. The system for attaching an abrasive article to a backing pad as claimed in claim 15, wherein said first, second and third layers of abrasive particles have substantially the same abrasive particle size and density.

18. A method for attaching an abrasive article to a backing pad comprising the steps of:

applying a loop textile material to an attachment surface of said backing pad, said loop textile material including a plurality of textile loops extending from said attachment surface;

adhering at least a first layer of abrasive particles to a first surface of an abrasive particle carrier;

adhering at least a second layer of abrasive particles to a second surface of said abrasive particle carrier; and releasably engaging said abrasive article to said backing pad by engaging said abrasive particles adhered to one of said first and second surfaces of said abrasive article carrier with said plurality of textile loops extending from said backing pad attachment surface.

19. The system for attaching an abrasive article to a backing pad as claimed in claim 10 further comprising a resilient layer disposed intermediate said first and said second attachment surfaces of said loop textile material.

* * * * *